US006182872B1

(12) United States Patent
Six

(10) Patent No.: US 6,182,872 B1
(45) Date of Patent: Feb. 6, 2001

(54) CONTAINER HOLDER

(75) Inventor: Michelle Six, Mesigny (FR)

(73) Assignee: Salomon S.A., Metz-Tessy (FR)

( * ) Notice: Under 35 U.S.C. 154(b), the term of this patent shall be extended for 0 days.

(21) Appl. No.: 09/393,692

(22) Filed: Sep. 10, 1999

(30) Foreign Application Priority Data

Sep. 11, 1998 (FR) ..... 98 11464

(51) Int. Cl.[7] ..... A45F 5/00

(52) U.S. Cl. ..... 224/148.5; 224/148.3; 224/148.7

(58) Field of Search ..... 224/148.3, 148.4, 224/148.5, 148.6, 148.7

(56) References Cited

U.S. PATENT DOCUMENTS

D. 310,942 * 10/1990 Woodall ..... 224/148.5 X
4,197,890 * 4/1980 Simko ..... 224/148.5 X
4,974,761 * 12/1990 Luque ..... 224/148.5 X
5,240,156 * 8/1993 Sicotte et al. ..... 224/148.5 X
5,397,039 * 3/1995 Parcelles ..... 224/148.5
5,570,824 * 11/1996 Lyon et al. ..... 224/148.5 X
5,722,574 3/1998 Pratt .
5,890,809 * 4/1999 Nelson ..... 224/148.5 X
5,915,580 * 6/1999 Melk ..... 215/386

OTHER PUBLICATIONS

Nike, Inc.: "Holiday 98 Men's/Women'sKid's Accesories", Nike Catalog "Accessories"Dec. 1997, XP002102562, Nike Bags: Hydra Falls.

* cited by examiner

*Primary Examiner*—Stephen K. Cronin
(74) *Attorney, Agent, or Firm*—Greenblum & Bernstein, P.L.C.

(57) ABSTRACT

A container holder with at least one pocket whose opening is directed upwardly, such pocket being adapted to contain a container. A funnel-shape introduction neck for the container is arranged in the area of the periphery of the pocket opening, the most splayed portion of the neck being directed upwardly and outwardly.

25 Claims, 2 Drawing Sheets

CONTAINER HOLDER

BACKGROUND OF THE INVENTION

1. Field of the Invention

The invention is related to a container holder of the type that is adapted for use with a bag, a back-pack, or a belt that can be adjusted at the user's waist, and that includes at least one pocket whose opening is directed upwardly, such pocket being adapted to house a canister.

2. Description of Background and Relevant Information

Known container holders of the aforementioned type generally have a pocket, whose opening is directed upwardly, and which is attached to a belt, either in a detachable manner, or a fixed manner. Furthermore, the pocket of these container holders is oriented perpendicularly, or substantially diagonally with respect to the belt such that in the transportation position, the container tends to remain inside by virtue of its own weight. In addition, for reasons of ease and habit, the pocket is usually provided with a curved opening so as to facilitate access to the container which, since it is normally carried on the back to allow the user to move his chest, is grasped "blindly" with only one of his hands. Also, a collar or an elastic necking and/or a lacing is often used to complete the pocket so as to prevent any accidental expulsion of the container during its transportation and, at the same time, to allow it to be extracted as desired.

All these technical constructional details ensure that such container holders are deemed to be relatively satisfactory especially when the user is not time-constrained and when his/her movements are not limited, as is generally the case for non-competitive sporting activities. Conversely, as soon as one has to deal with competitive sports and/or sporting activities during which the container must constantly be carried on the back, as is the case with cross-country skiing, bicycling, all-terrain biking, running, etc., it becomes difficult to execute the hand manipulations required, on the one hand, to gain access to the container so that it can be grasped and extracted from the pocket and, on the other hand, to gain access to the pocket so as to replace the container. As a matter of fact, these manipulations are executed "blindly" during the sporting event without the user ever really stopping, thus making it almost impossible for such user to locate the exact position of the pocket opening at the initial attempt to seize or replace the container.

SUMMARY OF THE INVENTION

It is an object of the instant invention to provide the user of a container holder of the aforementioned type, with a manually perceptible guide so that the hand can be directed exactly to the location of the pocket opening of the container holder, particularly when the manipulation is executed blindly.

Another object is to highlight the implemented guide function so that it becomes imprinted in the user's consciousness.

In order to achieve these ends, the container holder of the invention is the type having at least one pocket whose opening is directed upwardly, such pocket being adapted to contain the container, wherein a funnel-shaped container introduction neck, i.e., the widest portion of the neck, is arranged in the area of the pocket opening periphery, the most splayed portion of the neck being directed upwardly and outwardly.

According to one embodiment of the invention, the neck extends completely outside the pocket from the pocket opening periphery, thereby exposing its entire funnel shape.

According to another embodiment of the invention, the neck is fixed on the inside of the pocket, and is substantially set back from the pocket opening periphery, thereby only exposing the widest portion of its funnel shape.

By virtue of these arrangements, the user can locate the pocket opening simply by touch, i.e., without any visual aid. Indeed, as soon as the user brushes against the container introduction neck with his hand, or with the container that it is capable of holding, the position of the pocket opening becomes apparent. In addition, the funnel shape of the neck guides the hand and/or the container precisely up to the pocket opening.

In one embodiment, the pocket has a cylindrical contour, corresponding substantially to that of the container and is equipped with a support element for its connection with a belt. This support element is advantageously equipped with a comfort padding, for example, designed with a structure enabling air to circulate from the side directed towards the user, so as to allow both a pleasant contact with the user's waist as well as evacuation of perspiration.

In another embodiment, the pocket is closed laterally via the support element which is connected to the belt of the container holder. The canister introduction neck can therefore be obtained only on the pocket periphery.

The support element can have a variety of contours. For example, its contour can be defined by a triangle, one of whose sides is aligned with the belt, whereas the peak opposite that side is directed towards the ground. In addition, the pocket container holder can be positioned, with respect to the belt, such that it is in a vertical or diagonal position when the container holder is adjusted at the waist.

BRIEF DESCRIPTION OF THE DRAWINGS

The invention will be better understood with reference to the attached schematic drawings illustrating, as non-restrictive examples, some embodiments of the canister holder.

DETAILED DESCRIPTION OF THE INVENTION

Figure 1:
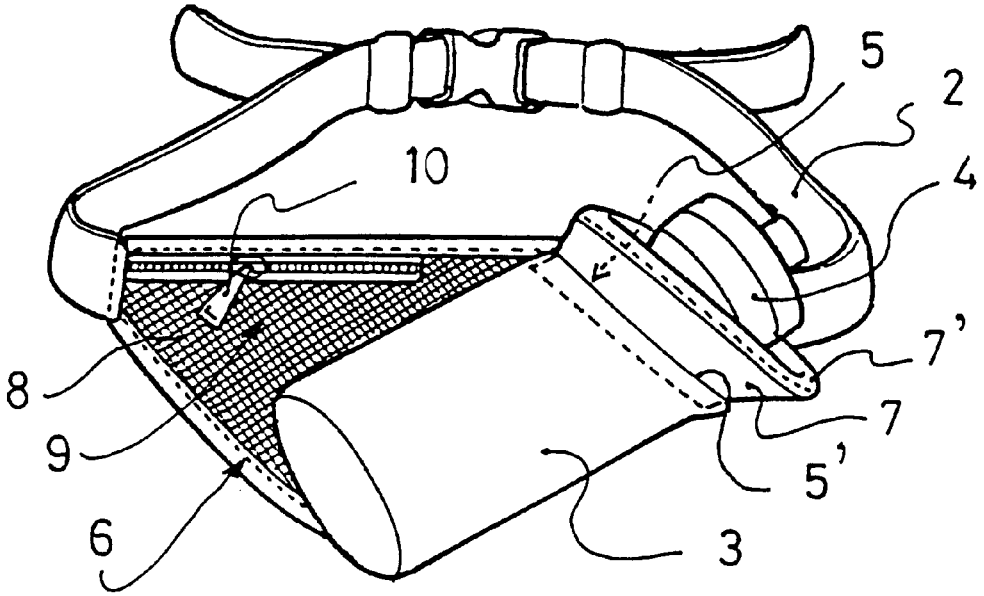
FIGS. 1 and 2 illustrate a container holder that can be adjusted around the user's waist, made according to the invention, FIG. 1 representing it in an overall top view in its transportation position, and FIG. 2 showing the access zone to the container as seen from the top.
Figure 2:
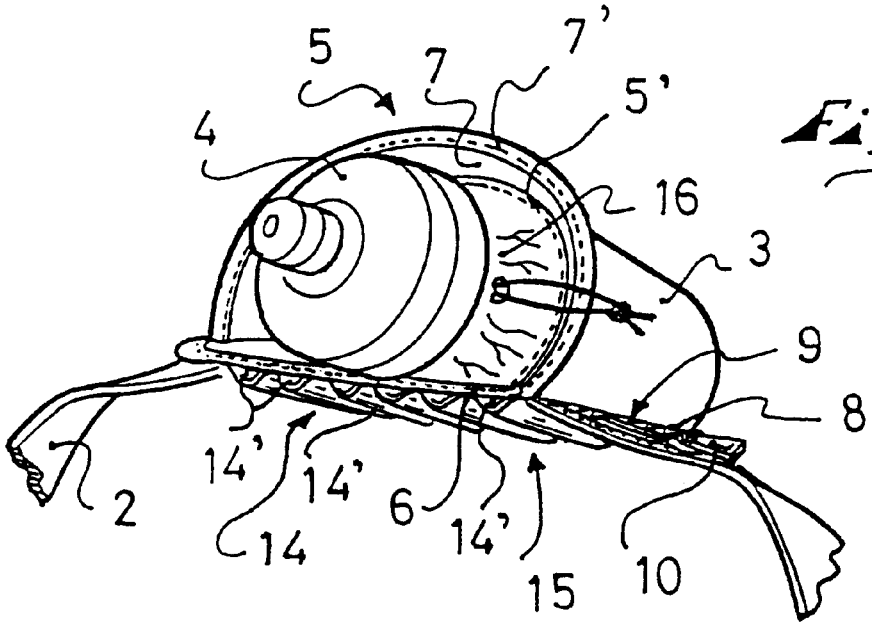

The container holder illustrated in FIGS. 1 and 2 is of the type that is adjusted onto the user's waist by means of a belt 2. It has a pocket 3 whose opening 5 is directed upwardly, and which is adapted to contain a container 4 in this embodiment, the pocket 3 is closed laterally on the side 15 that presses against the user by means of a downwardly pointing triangular support element 6, that ensures its connection with the belt 2. This support element 6 can have a variety of contours as long as it provides an adequate affixing zone for the pocket 3.

In order to minimize discomfort to the user's back, and in order to facilitate access to the opening 5 of the pocket 3, such pocket is advantageously placed diagonally on the support clement 6 with respect to the belt 2. More specifically, in the embodiment represented, the opening 5 of the pocket 3 is directed towards the right when the container holder is in the transportation position and placed on the user's back. The container holder that has a pocket 3 inclined in this manner is specifically intended for right handed users. The pocket 3 can also be placed diagonally in a way that its opening 5 is directed towards the left for left handed users.

Thus, with its right or left diagonal arrangement, the pocket 3 leaves a zone or portion 8 free of the support element 6 on the side opposite the one where it extends. Advantageously, this portion 8 is equipped with a flat pocket 9 having a zipper closure 10.

The opening 5 of the pocket 3 of the container holder is equipped with a neck for introducing the container 4. This funnel shaped introduction neck 7 is attached to the pocket 3 at a peripheral end portion of the pocket, i.e., in the area of the periphery 5' of the opening 5, and its most splayed part 7', i.e., the widest part of the neck 7, is directed upwardly and outwardly from the pocket 3. The introduction neck 7 is thereby upwardly and outwardly flared.

Figure 3:
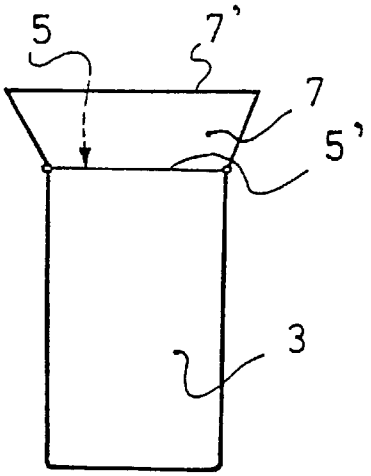
FIGS. 3, 4, and 5 schematically illustrate various embodiments of the invention as applicable to container holders that can be adjusted around the user's waist.
Figure 4:
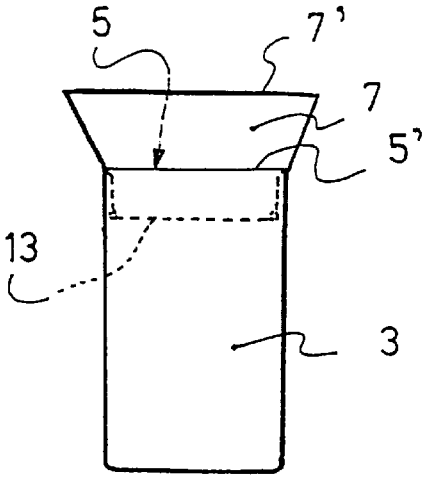

According to various embodiments, illustrated schematically with reference to FIGS. 3 and 4, the introduction neck 7 can extend completely outside the pocket 3 from the periphery 5' of the opening 5 thereof (FIG. 3), or have a narrow end 13 fixed substantially set back from said periphery 5', and preferably, towards the inside of the pocket 3 (FIG. 4) as represented in dotted and dashed lines.

Advantageously, the pocket 3 is equipped with a comfort padding 14 on the side 15 directed towards the user as is visible in FIG. 2. This padding 14 is designed with a structure 14', constituted, for example, of a series of ribbings 14' allowing air to circulate and/or perspiration to be evacuated.

In order to prevent an accidental expulsion of the container 4 from the pocket 3, a necking 16, constituted for example, by a bellows, or pleated portion, with elastic lacing, is arranged to be set back from the widest part 7' of the introduction neck 7.

Figure 5:
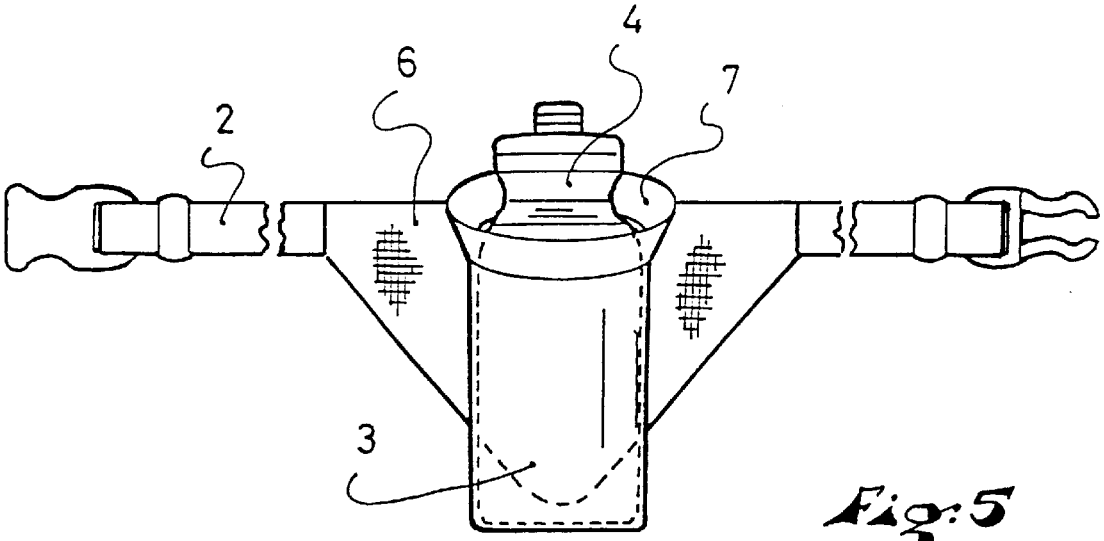

The canister holder as illustrated in FIG. 5 includes, as does the holder described above, a belt 2 connected to a support element 6 and a pocket 3, adapted to contain a container 4, which is equipped with an introduction neck 7. In this embodiment, the pocket 3 is arranged in a way so as to be approximately perpendicular to the belt 2. In this way, when the container holder is in tie transportation position on the user's waist, the container 4 remains in the vertical position.

It is to be understood that the container holder with a pocket 3 for the container 4 equipped with an introduction neck 7 can be made in other ways without, however, leaving the scope of the invention.

The neck 7 can be constituted of an attached piece or be integrated directly into the pocket.

For example, the pocket 3 can be fixed and/or attached directly on the belt 2 via stitches, adhesives, self-gripping textile structures, such as hook and loop fasteners, or in other manners etc.

The container holder can also have several pockets 3 adapted to contain containers 4 or any other equivalent containers, whether for liquids or for products having some consistency.

Finally, the container holder can be integrated directly into a back-pack or waist pack without leaving the scope of the invention. Indeed, in the embodiments cited, the belt 2 and/or the support element 6 for the pocket 3, are replaced by the pack itself with its carrying system.

What is claimed it:

1. A canister holder comprising at least one pocket having an upwardly directed opening, said pocket being adapted to contain a canister, wherein a funnel-shaped introduction neck for the canister is arranged in an area of the periphery of the pocket opening, the funnel-shaped introduction neck having a most splayed portion directed upwardly and outwardly from the pocket opening.

2. A canister holder according to claim 1, wherein the neck is fixed inside the pocket and substantially set back from the periphery of the pocket opening.

3. A canister holder according to claim 1, wherein the canister pocket is directly connected to the belt.

4. A canister holder according to claim 1, wherein the pocket comprises a necking that is arranged to be set back from the most splayed part of the introduction neck.

5. A canister holder according to claim 1, wherein the introduction neck is constituted of an attached piece.

6. A canister holder according to claim 1, wherein the introduction neck is integrated to the pocket.

7. A canister holder according to claim 1, wherein the neck extends completely outside the pocket from the periphery of the pocket opening.

8. A canister holder according to claim 2, wherein the pocket is equipped with a support element ensuring its connection with a belt.

9. A canister holder according to claim 8, wherein the support element is equipped with a comfort padding on the side directed towards the user.

10. A canister holder according to claim 8, wherein the pocket is closed laterally by the support element on the side that presses against the user when the canister holder is adjusted at the waist.

11. A holder for a container, said holder comprising:

at least one pocket having an upwardly directed opening, said upwardly directed opening being defined by a peripheral end portion of said pocket; and an introduction neck having a narrower end portion and a wider end portion, said narrower end portion being connected to said pocket at said peripheral end portion of said pocket.

12. A container holder according to claim 11, wherein:

said introduction neck is positioned entirely outside of said pocket from said opening of said pocket.

13. A container holder according to claim 11, wherein:

said introduction neck has an upwardly and outwardly flared portion extending from said narrower end portion;

said narrower end portion of said introduction neck is fixed to said pocket inside said peripheral end portion of said pocket, said narrower end portion thereby having an end substantially set back from said upwardly directed opening of said pocket.

14. A container holder according to claim 11, wherein:

said pocket comprises a necking connected to said introduction neck and adapted to surround a container within said pocket, to prevent accidental expulsion of the container from said pocket.

15. A container holder according to claim 11, wherein:

said introduction neck is constituted of an attached piece.

16. A container holder according to claim 11, wherein:

said introduction neck is integrated to said pocket.

17. A container holder according to claim 11, further comprising:

a belt adapted to surround a waist of a user; and a support element affixed to said belt;

said pocket being secured to said support element.

18. A container holder according to claim 17, wherein:

said pocket is directly connected to said belt.

19. A container holder according to claim 17, wherein:

said support element comprises a first side adapted to face a portion of the user and a second, opposite side adapted to face away from the user, the container holder further comprising a comfort padding on said first side of said support element.

20. A container holder according to claim 19, wherein:

said pocket is closed laterally by said support element on said first side.

21. A holder for a container, said holder comprising:

at least one pocket having an opening with a determinate size, said opening being defined by a peripheral end portion of said pocket;

a flared introduction neck having a first end portion and a second end portion, said first end portion of said introduction neck connected to said peripheral end portion of said pocket, said second end portion of said introduction neck extending away from said peripheral end portion of said pocket, said second end portion having an opening with a size greater than said determinate size of said opening of said pocket;

a support element adapted to be secured to a user, said pocket being secured to said support element and to hold said container in a transportation position, said opening of said pocket being adapted to be upwardly directed in said transportation position.

22. A holder according to claim 21, wherein:

said opening of said pocket is adapted to be directed vertically upwardly in said transportation position to hold the container in a vertical position.

23. A holder according to claim 21, wherein:

said opening of said pocket is adapted to be inclined from vertical in said transportation position to hold the container in an inclined position.

24. A holder according to claim 21, further comprising:

a belt extending in a determinate direction, said support element being secured to said belt;

said pocket extending non-perpendicularly to said determinate direction of said belt, said opening of said pocket being directed upwardly and said pocket being adapted to hold the container in an inclined position in said transportation position.

25. A holder according to claim 21, further comprising:

a belt extending in a determinate direction, said support element being secured to said belt;

said pocket extending perpendicularly to said determinate direction of said belt, said opening of said pocket being directed vertically upwardly and said pocket being adapted to hold the container in a vertical position in said transportation position.

* * * * *